US006701594B2

(12) United States Patent
Bruyn

(10) Patent No.: US 6,701,594 B2
(45) Date of Patent: Mar. 9, 2004

(54) SYSTEM FOR SECURING INTERFACE STRIPS AT ROAD/RAIL CROSSINGS

(75) Inventor: Dominicus Bruyn, Cambridge (CA)

(73) Assignee: Performance Polymers Inc., Cambridge (CA)

( * ) Notice: Subject to any disclaimer, the term of this patent is extended or adjusted under 35 U.S.C. 154(b) by 0 days.

(21) Appl. No.: 10/076,498

(22) Filed: Feb. 19, 2002

(65) Prior Publication Data

US 2002/0073525 A1 Jun. 20, 2002

Related U.S. Application Data

(63) Continuation-in-part of application No. 09/105,801, filed on Jun. 12, 1998, now Pat. No. 6,401,318.

(30) Foreign Application Priority Data

Jun. 16, 1997 (GB) ..... 9713171

(51) Int. Cl.[7] ..... B25B 27/14

(52) U.S. Cl. ..... 29/257; 29/270; 269/249; 269/270; 238/8; 238/378

(58) Field of Search ..... 29/559, 238, 271, 29/257, 256, 267, 270, 276, 281.1, 283; 404/75; 238/2, 8, 315, 310, 377, 378

(56) References Cited

U.S. PATENT DOCUMENTS

| | | | | |
|---|---|---|---|---|
| 2,016,088 A | * | 10/1935 | Hargrave | 29/283 |
| 3,934,316 A | * | 1/1976 | Driscoll | 269/249 |
| 5,899,379 A | * | 5/1999 | Bruyn et al. | 238/8 |

FOREIGN PATENT DOCUMENTS

| | | | |
|---|---|---|---|
| CA | 1194010 | * | 9/1985 |
| EP | 0342878 A2 | * | 11/1989 |
| GB | 1429968 | * | 3/1976 |

* cited by examiner

*Primary Examiner*—Gregory Vidovich
*Assistant Examiner*—Jermie E. Cozart
(74) *Attorney, Agent, or Firm*—Anthony Asquith & Co.

(57) ABSTRACT

At a crossing, rubber interface strips are positioned between the rails and the asphalt or concrete. A U-shaped spring-clip fits underneath the rail, and has upstanding arms that carry tappets, which engage the strips. One of the arms is threaded, and carries a screwed tappet-rod. Turning the tappet-rod closes the distance between the tappets, clamping the strips onto the sides of the rail, and forcing the springy arms apart. The spring-clips are manipulated into position while in an unstressed condition. The spring-clip is only brought up to force when finally assembled. Assembly can be done without tools, and with little danger of mix-assembly, or of injury to workers.

15 Claims, 6 Drawing Sheets

SYSTEM FOR SECURING INTERFACE STRIPS AT ROAD/RAIL CROSSINGS

This is a Continuation-in-Part patent application, based on U.S. patent application Ser. No. 09/105,801, filed Jun. 12, 1998, now granted as U.S. Pat. No. 6,401,318.

This invention relates to road/rail level-crossings, and in particular to the installation of the rubber interface strips that fit between the metal rail and the asphalt or concrete of the road.

Rubber strips of the kind with which the invention is concerned are shown, for example, in patent publication CA-1,194,010 (EPTON, Sep. 24, 1985).

BACKGROUND TO THE INVENTION

A problem with the rubber strip interface systems has been in the manner of attaching the rubber strip to the rail. It is necessary for the strips to be held firmly against the sides of the rail while the asphalt or concrete is being applied. If the strips can become loose relative to the rails at this time, the effect is that the road material cannot be properly compacted, which can have a serious effect on the service life of the crossing. When a crossing needs repair, it is usually because the road material has cracked or crumbled particularly at the line where the road material touches the rubber strips, and care in keeping the strips tight against the rails when the road material is being applied can make a difference of several years before the onset of crumbling at this line. The major purpose in providing rubber interface strips is to protect the road material from crumbling, but the system can only achieve its potential in this regard if the strips are held firmly against the rails when the road surface is being applied.

Once the road surface has been applied, and has hardened, the road material itself acts to hold the strips against the rails. That is to say, the road material supports the strips, while at the same time, of course, the strips support the road material.

The present invention is aimed at making it possible to squeeze the rubber pieces tightly against the side of the rail with a strong and reliable gripping force. It is also an aim that the means for applying the force can be assembled, and the heavy squeezing forces can be generated, using inexpensive components, which can be installed simply and safely.

While repairs are being carried out to a road-rail crossing, it is usually necessary to close the crossing to (road) traffic. Therefore, it is important that the work be completed quickly. Since the work is done relatively infrequently at a given location, it is not uncommon for the work crew to include many workers who have never worked on a crossing before. While the work should be done quickly, the emphasis is not that minutes count, but rather that the work must be completed within the allowed window of time. The designer of the repair system should see to it that the work can be completed without the need for special tools, and in a manner that requires no more than a minute or two of training. Safety of workers who are generally unfamiliar with the tasks is important. It is important that the preparations prior to pouring the asphalt or concrete be easy to inspect; i.e the engineer should be able to tell at a glance that all the work has been completed and has been done properly. The less time and skill he has to expend in checking, and the more plainly obvious it is that incomplete work is incomplete, the better. It is very expensive to come back later to correct any problems.

THE PRIOR ART

Traditionally, in order to hold a rubber interface strip against the side of the rail, a spike has been driven partially into the wood of the cross-tie, and the protruding head of the spike bent over until it touches the rubber. The spike-head is bent over by striking it in a lateral direction with a hammer. Such a system, i.e bending partially-driven spikes over into contact with the strips, contains the potential for a number of problems, such as damage to the wood, improper bending over of the spike head, etc.

An example of the bent-over spike system is shown in the publication entitled EPTON RAILSEAL.

In many jurisdictions, bending the spikes over is unacceptable, not least because of the high risk of injury to the installation workers. Also, of course, when the cross-ties are made of concrete, spikes cannot be driven-in in any event. For such cases, U-shaped spring-clips have been proposed, which lie underneath the rail, the arms of the spring-clip being bent apart in order to load the rubber strips laterally against the sides of the rail. The problem with the traditional spring-clip is that it is difficult to apply the heavy forces necessary to install the spring-clip into place over the strips, at least in the absence of elaborate special tools. It is recognized that the skill level required for installing these spring-clips efficiently (and safely) is somewhat outside the traditional level at which contractors for repairs to level-crossings operate. In fact, the skill level needed to install spring-clips is unlike that needed generally for the rest of the tasks involved when repairing level-crossings, and the contractor does not wish to engage specially-trained operators just for that one task.

Indeed, it may be pointed out that the task of securing the rubber strips by side-hammering partially-driven spikes is not in keeping either with the rest of the tasks involved when repairing level-crossings, which is another reason why bending spikes over is not favoured. Even so, driving railway spikes is a widespread recognized skilled trade, whereas installing spring-clips is not.

An example of the traditional type of U-shaped spring-clip is shown in the publication entitled EPTON RAILSEAL FOR CONCRETE TIE APPLICATION.

It is another aim of the present invention that the system for securing the rubber strips to the sides of the rails be foolproof, whereby even an unskilled novice labourer cannot assemble the components wrongly, nor can he hurt himself.

GENERAL FEATURES OF THE INVENTION

The system of the invention involves the use of a metal (e.g. spring-steel) spring-clip. The spring-clip is of a U-configuration, having a central beam and having left and right arms integrated therewith. Left and right tappets are arranged for contact with left and right tappet-receiving points (e.g. grooves) on the side-surfaces of the strips. In the invention, the tappets are adjustable as to their relative separation. The tappets can be forcefully moved or adjusted apart, preferably, for example, by means of a screw thread connection between the tappet and the arm. The following procedure may be used when installing the strips: first, the clips are manipulated underneath the rail; then, the strips are placed against the rail; then, the clips are manoeuvred into place around the strips; then, the tappet distance is adjusted to take up the slack and to bring the tappets into contact with the strips; then force is applied between the tappets, which compresses the strips against the sides of the rail, and bends the two arms apart, thereby clamping the strips resiliently to the sides of the rail.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples that embody the invention. It should be noted that the scope of the invention is defined by the accompanying claims, and not necessarily by specific features of exemplary embodiments.

Figure 1:
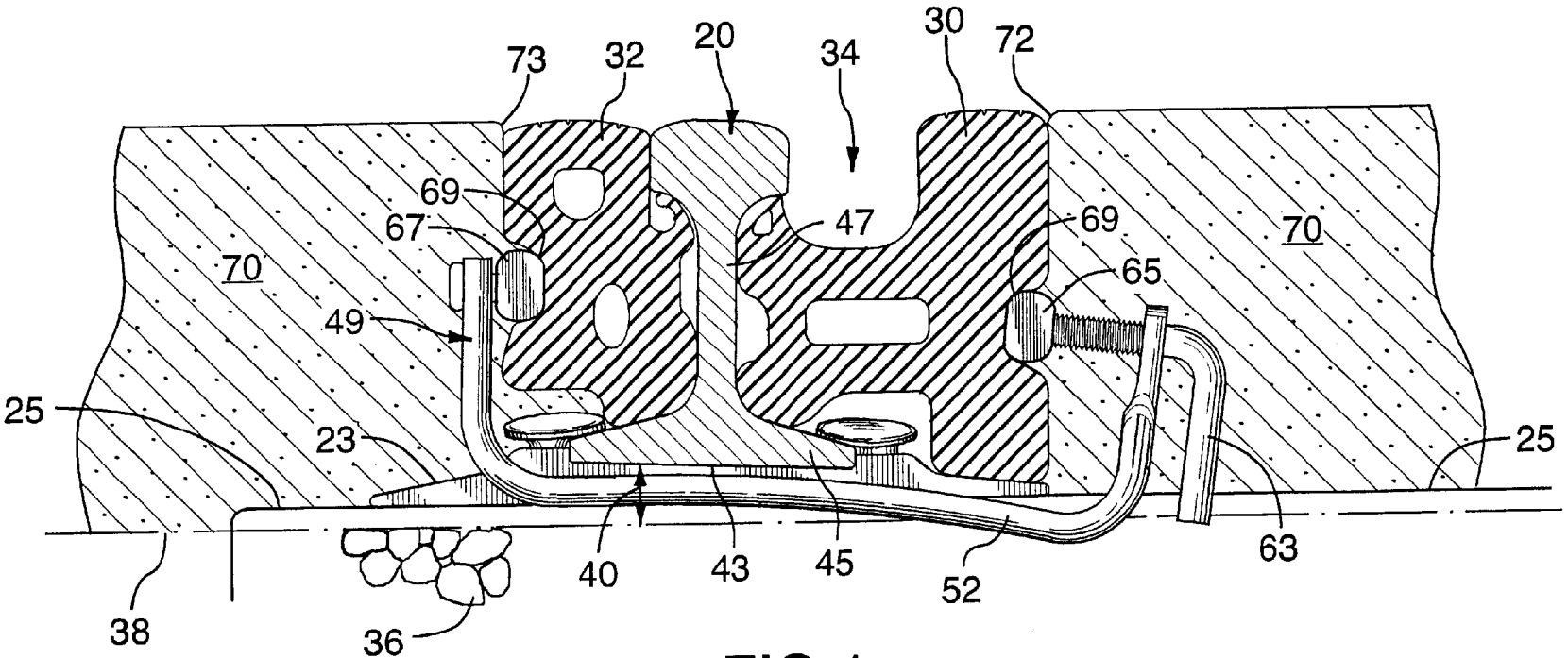
FIG. 1 is a sectioned end elevation of a section of railway track, at a rail-road crossing, showing sections of rubber interface, held in place by a spring-clip apparatus that embodies the invention.

In FIG. 1, the (steel) rail 20 is mounted in the usual way on a chair 23, which in turn is mounted on the usual cross-tie 25. Spikes 27 hold the rail and chair to the tie. (The other rail of the railway lies to the right in FIG. 1.) The profile of the track-side rubber interface 30 is quite different from the profile of the field-side interface 32, mainly because of the recess 34, which accommodates the flanges of passing railway wheels.

The cross-ties 25 are set in the usual ballast 36, the line 38 indicating the general level of the ballast. The ballast is set so that the level 38 is just below the level of the top of the cross-tie 25. Thus, as a general rule, in the area between the cross-ties, a gap 40 exists between the under-surface 43 of the base 45 of the rail 20, and the top 38 of the ballast 36. This gap 40 is in the region of 2 to 4 cm.

The two rubber interfaces 30, 32 are held clamped against the sides of the web 47 of the rail 20 by means of the spring-clip 49. The spring-clip 49 passes underneath the base 45 of the rail, and lies in the gap 40. The FIG. 1 cross-section is taken at a point between two cross-ties; the spring-clip 49 is located half-way between the cross-ties; thus, in a case where the cross-ties lie, say, 60 cm apart, it will be understood that the chair 23 and tie 25 in FIG. 1 lie some 30 cm behind the spring-clip 49.

At a typical road/rail level crossing, several of the spring-clips 49 are used. The spring-clips are intercalated with the cross-ties lengthwise along the rails, right across the width of the road. Of course, the rubber interfaces and the spring-clips are duplicated for the other rail of the railway track. The rubber interface strips are made from extruded rubber, which comes in lengths of 2 to 4 metres. Where the road is wider than that (which it usually is) the rubber pieces are joined together lengthwise.

The strips of rubber 30, 32 are placed against the sides of the rail, and then the spring-clips clips 49 are installed. The operator lays the spring-clips underneath the base of the rail, i.e through the gap 40 between the rail and the ballast. The spring-clip must be laid flat to accomplish this, and then the spring-clip is rotated until the arms of the spring-clip lie vertically, once the spring-clip is in place underneath the rail. It may be necessary to remove a few pebbles of the ballast, if the level 38 of the ballast is higher than usual, but generally the operator has ample room to install the spring-clips without touching the ballast.

Figure 2:
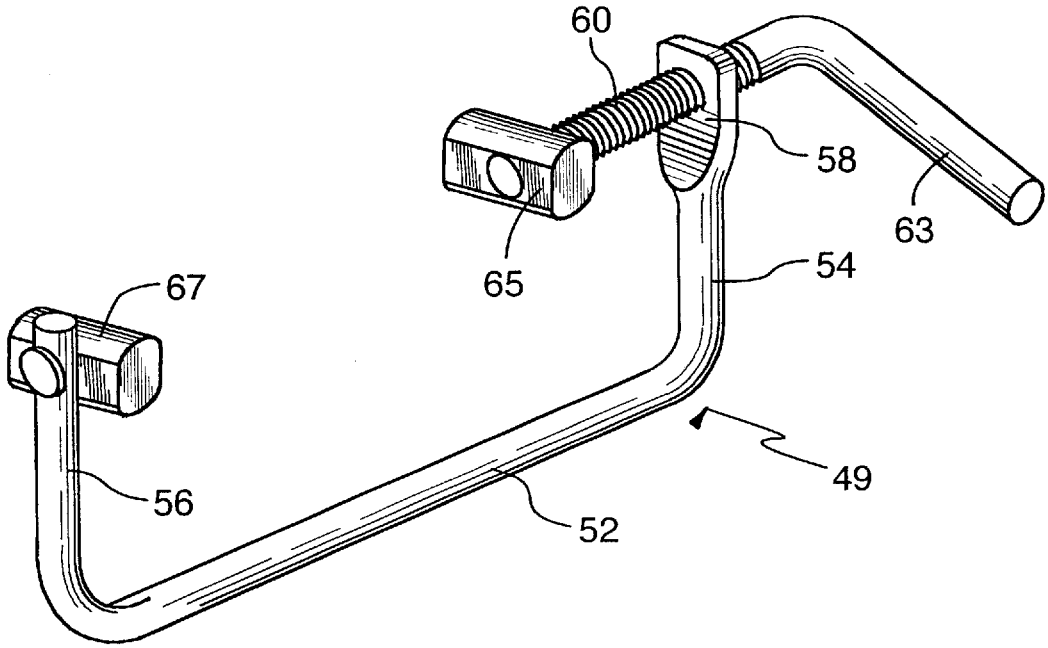
FIG. 2 is a portion of the same elevation, shown at a stage of installation.

The spring-clip 49 is as shown in FIG. 2. The spring-clip includes a main beam 52, and two side-arms 54, 56. One arm 54 is flattened at its end 58, and is provided with a threaded hole therein. A screwed rod 60 is screwed into the arm 54, and the rod is provided with a handle 63.

Carried on the end of the screwed rod 60 is a tappet 65. The tappet is so attached to the rod that the tappet can rotate; or rather, so that the tappet can remain still while the screwed rod rotates. A second tappet 67 is carried on the other arm 56. The tappet 67 need not be mounted for rotation, although it can be; and there is a manufacturing benefit if both tappets are the same.

The operator winds the handle 63, to unscrew the rod 60 a sufficient distance that the tappets can be easily slid into place, into the tappet-receiving-grooves 69, which are provided in the side profiles of the rubber pieces for receiving the tappets.

Now, the operator turns the handle 63, and winds the screwed rod so that the tappets 65, 67 are driven towards each other. The arms 54, 56 are spread apart by this action, and the beam 52 is put into a state of bending. The completed installation condition is as shown in FIG. 1.

For best results, the rubber pieces should be pressed against the rail with a clamping force at each spring-clip in the 2 or 3 kN range. It is recognised that such force is readily available with the kind of spring-clip as shown, i.e one in which the beam and arms are bent from round steel bar of about 15 or 20 mm diameter. The required distance between the tappets typically is around 20 cm, and the length of the arms is 9 cm, whereby the required force can be achieved when the arms are prised apart some 6 or 7 cm. The screw thread allows that distance to be taken up by simple hand action of the operator.

When the tappets are fully engaged in their grooves on the sides of the rubber strips, and when all slack is taken up, but no compressive force has yet been applied between the tappets, the distance apart of the tappets at this slack-take-up position typically is around 21 cm. When the full compressive load has been applied to the strips, it may be expected that the strips will be compressed somewhat, whereby the distance between the tappets has dropped by about 1 cm. At the same time as the rubber strips are being compressed, the spring-clip is deflecting, as the tappets are forced together. Thus, although the distance apart of the tappets reduces by only 1 cm, the tappet adjustment mechanism on the spring-clip has to be operated as if to move the tappets together a much greater distance than that; for example, as mentioned, the tappet adjustment mechanism, in order to achieve the 1 cm compression of the rubber strips, might undergo the equivalent of 6 or 7 cm of no-load movement of the tappets.

With different rail profiles, different rubber profiles, different compressibilities of the rubber, etc., the distance apart of the tappets at full compression may be some distance other than about the 20 cm as mentioned. However, the fully-compressed distance should not be much smaller; preferably, it should not be less than about 15 cm.

As shown in FIG. 1, the spring-clip is installed with the handle towards the track side. However, the spring-clip could be positioned with the handle towards the field-side, if preferred. If all the handles are on the same side, inspection to ensure that all the spring-clips are correctly installed is somewhat easier.

After the spring-clips are all installed, the road is made-up by pouring on asphalt 70, in the usual way.

Of course, the asphalt will not fill tightly into all the nooks and crannies around the spring-clips, even after being well-compacted. But it is the surface of the asphalt that counts, and the extent to which the asphalt starts to crumble, after a few years, at the points 72,73, that determines the length of time before re-asphalting has to take place.

These areas 72,73 are far enough away from the spring-clips not to be affected directly thereby. However, a prudent installation engineer would see to it that all the handles are pointing downwards prior to applying the asphalt.

One of the traditional problems with rubber interfaces of the kind described herein, when traditional fastening methods have been used, is that the rubber tends to wander—both to slip down or rotate down inside the rail profile, and also to slide lengthwise along the rail. After several years, sometimes the rubber interfaces have been quite severely displaced. When that happens, the asphalt is left unsupported, and can crumble badly. (It should be noted that the asphalt takes support from the rubber, not the other way round.)

But when the spring-clips as described herein are used, the rubber is attached to the rails very firmly indeed, and therefore the tendency of the rubber to wander and creep, as the years go by, is largely eliminated. The expectation is that the rubber will be in exactly the same place on the rail after several years, as it was the day the asphalt was poured. As a result, the asphalt may be expected to remain firm and coherent for several years, even in the areas 72, 73. Traditionally, the shortcomings of the manner of attachment of the rubber to the rails has been the main factor leading to the need for early re-asphalting, and this shortcoming is exactly addressed by the new design of spring-clip. But of course, the asphalt can also break up because the ballast was not correctly set for the traffic, and that aspect becomes more important now that the asphalt can be expected not to deteriorate because of creeping of the rubber.

The spring-clips should be corrosion-protected. However, the standard of protection need not be high. Once the spring-clip is installed, it is protected by being covered by the asphalt, and besides it would take centuries for the spring-clip to rust enough to lose its locked-in forces. It does not matter if the screw-threads seize up due to corrosion. In a case where asphalt needed to be replaced, the spring-clips would have to be replaced also, although the rubber can usually be re-used. The act of removing the old asphalt would inevitably damage most of the spring-clips, and so the old spring-clips would be removed by bolt-cutters, or torches, not by trying to unwind the screwed rods.

The beam 52 is circular in cross-section. It might be considered that because the beam 52 of the spring-clip is stressed in bending that the beam should be of a rectangular section, or even an I-beam section. However, if the spring-clip were to fail because of over-stressing, it is likely that the mode of failure would be, not bending of the beam 52, but torsion-buckling of the arm 54. That being so, in fact circular is the preferred cross-section, besides being the least expensive. In fact, a slight flattening of the profile from the strictly circular is preferred, of the diameter in the plane of the clip. Slight variations in the diameter can affect the spring rate, and the flattening assists in keeping the rate as predicted. Besides, given that the spring-clip is highly stressed, in use, and the flattened surfaces represent the areas where the stress is at the highest, the flattening ensures that the stresses are well-distributed and accommodated. Also, the flattening assists in ensuring that the two bent-up arms are aligned in the same plane.

It should be noted that the bending moment on the beam 52 is constant, whereby the material of the main beam is being used efficiently. The spring-clip does not touch any part of the structure other than the grooves 69 in the side faces of the rubber profiles.

Thus, the spring-clip touches nothing but the grooves 69 after installation, but furthermore, in fact the spring-clip need touch nothing else during installation, despite the fact that large forces are being applied to the arms. The arms 54,56 of the spring-clip can be forced apart by the operator applying no other force than turning the handle.

This may be contrasted with a design in which, for example, in order to prise the arms apart, the manner of prising the arms apart required a force to be also exerted downwards onto the ballast. Such a design would be at a disadvantage because the ballast is not always at the same height.

The use of special tools might be contemplated for the installation work, but special tools generally are contraindicated for level-crossing installation work. This is because of the nature of the contracting firms; level-crossing contracts are occasional (and they are likely to become even more occasional, now that the time between re-asphalting can be extended by the use of the spring-clip as described herein) and so special tools would be mislaid between jobs. A design that required a tool that could be economically supplied for each contract and then discarded after the contract was finished might be acceptable. However, preferably, the work should be of such a nature as not to require the use of tools, and especially not special tools.

The inexpensive screw thread system as described herein allows the force to be applied to prise the arms apart without the need for steadying forces or reactions, for example from the ballast or from the rail itself. And, once set, the arms stay locked apart.

There is virtually no failure mode under which the arms might suddenly collapse, and which might be dangerous to the operator. The system requires ballast to be excavated from below the rails only to a minimum extent, if at all. The system avoids the need for special tools, or indeed for tools at all, in that the spring-clips can be installed solely by the use of the hands.

Even though the spring-clips clamp the rubber strips onto the rail with considerable force, the operator can provide such force simply by turning the handle of the screwed rod. It may be noted that the operator cannot overload the spring-clip. The operator can only turn the handle until the thread bottoms out, and the designer can provide that when that occurs the desired load has been reached. In fact, the designer can provide that the operator simply turns the handle of every spring-clip until the thread bottoms out.

The number of spring-clips per crossing varies in the 50 to 100 range. The task of manipulating the spring-clips into place, and screwing the screwed rods at each spring-clip, can be undertaken by even the most casual of workers. All the workers can be set to the task of screwing the screwed rods; this may be contrasted with bending over the spikes in the traditional system, where there might be only one skilled spike-driver available to attend to all the spikes.

The spring-clips should not be made too large. Preferably, it should be possible to manipulate the fully open (i.e retracted) spring-clip around the strips, but only just. Then, if the strips are not fully in place against the side of the rail, that fact will be apparent to the worker in that he now has difficulty in getting the spring-clip to straddle the strips. If that is encountered, he knows to kick the strip more firmly against the rail.

Figure 4:
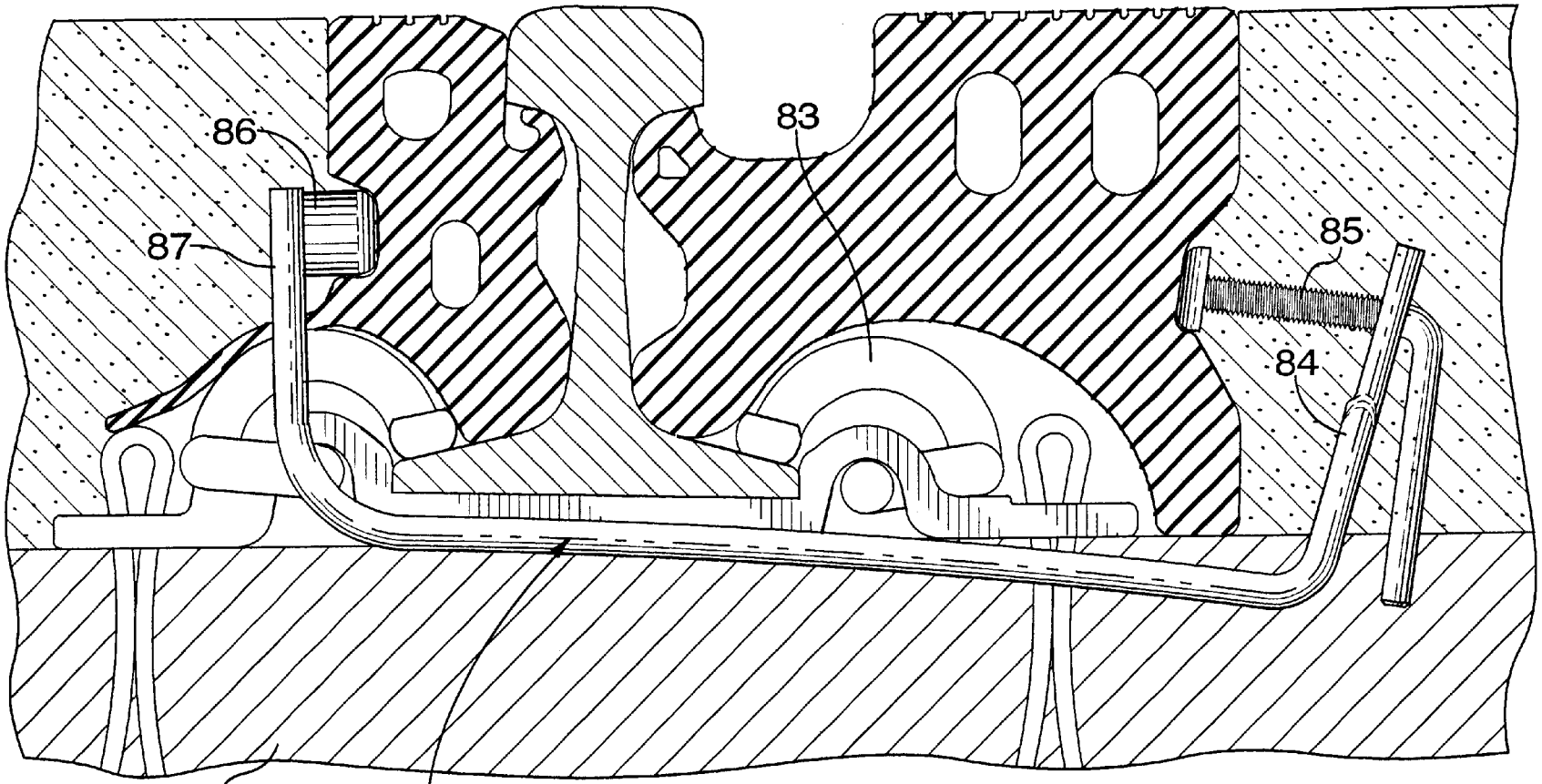
FIG. 4 is a cross-section of railway track, in which the cross-ties are of concrete, and the rails are secured to the cross-ties with pandrol clips.

FIG. 4 shows an example of a spring-clip 80 of the type as described herein applied to a railway system that uses concrete cross-ties 82. (Sometimes, cross-ties are made of metal, and a similar spring-clip can be used in that case too.) FIG. 4 shows the use of pandrol-clips 83 to hold the base of the rail down onto the cross-tie. In FIG. 4, the alignment of the right arm 84, and of the threaded hole therein, is such that the axis of the threaded tappet-rod 85 is in a straight-line alignment with the left tappet 86 at the condition of maximum load, when the left and right arms 87, 84 have been bent apart. There might be a tendency for the tappet-rod 85 to buckle, in an extreme case, and this tendency might be exacerbated if the tappet-rod were to lie at an angle to the line of the force under the conditions of maximum force.

Figure 5:
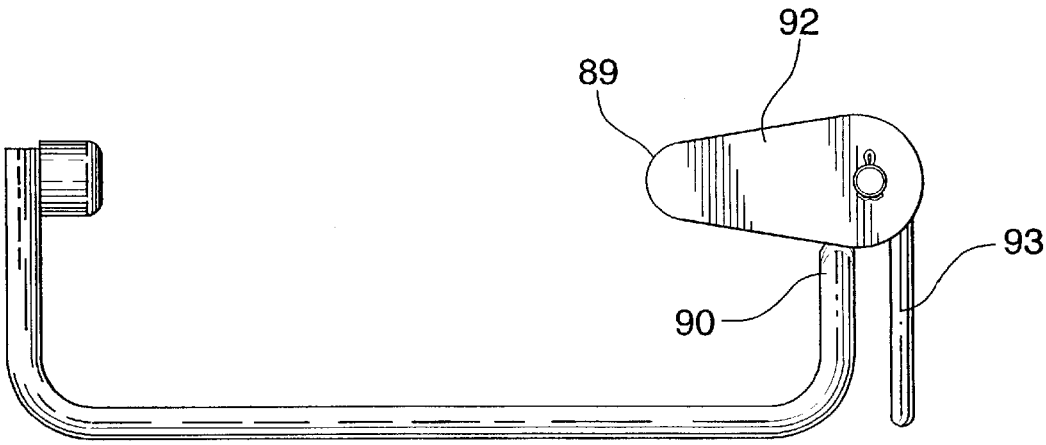
FIG. 5 is an elevation of a spring-clip, showing another spring-clip apparatus that embodies the invention.

FIG. 5 shows another example of a spring-clip. In this case, the means for adjusting the distance between the right tappet 89 and the right arm 90 is a cam 92, which is operated by turning the lever 93.

Figure 6:
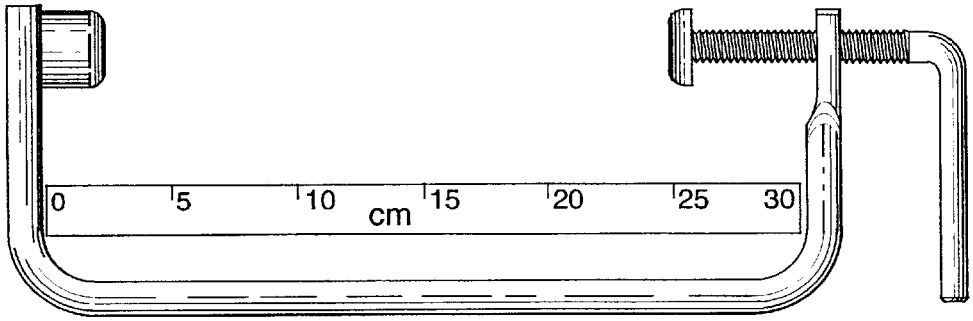
FIG. 6 is an elevation, which includes a scale, of a preferred form of spring-clip.

FIG. 6 is a scaled view of an exemplary spring-clip. The span of spring-clip, i.e the length of the beam portion of the spring-clip, in this case is about 32 cm. This distance is set in accordance with the requirements for straddling the two interface strips assembled to the sides of the rail. The designer would have to increase (decrease) the span of the beam if the straddle distance were larger (smaller).

It will be understood that the main function of the spring-clip is to provide a particular desired level of force, for holding the two interface strips against the sides of the rail. If the clamping force were too large, that would be wasteful, and the strips might even be distorted, or pushed out of position, by too heavy a force. On the other hand, the force should not be too light, because then the strips might be a little out of position, or might move during pouring of the asphalt or concrete, or be otherwise improperly held. As mentioned, it is recognized that the force of clamping preferably should be in the 2–3 kN range.

Thus, the designer wishes to ensure that all the spring-clips exert a force in the 2–3 kN range. However, the designer cannot expect the installation workers to measure the clamping force, as such. Rather, the workers preferably should be called upon merely to set the spring-clip to a particular deflection, and not to carry out the much more sophisticated task of setting the clips to a particular level of force, as such.

The designer preferably should set the installation worker the task, not of tightening a screw until a certain force is achieved, but the much easier task of merely tightening a screw to a stop.

The task of the designer is to ensure that, when the arms of the spring-clip have been bent apart to a particular distance, the force produced between the arms for clamping the strips to the rail then will inevitably be within the desired range.

However, the rubber strips are subject to dimensional tolerance variations, and these variations can be quite considerable, given the nature of extruded rubber. Also, the shape of conventional railway rails is hardly conducive to accurately repeatable positioning of the rubber strips against the rails. For these reason, the distance apart of the tappet-receiving-grooves on the strips can vary to a considerable degree. A difference of 1 cm is common, and even as much as 2 cm might be encountered, in what is nominally supposed to be the same groove-to-groove straddle dimension.

This possibility for large variations in the straddle distance makes it all the more difficult to ensure that the desired force of 2–3 kN is present when the spring-clip has been assembled and installed. The designer should aim for a sufficiently low spring-rate of the spring-clip to ensure that, even though the deflected-apart distance might vary by a centimeter or two from one spring-clip to another, the deflected-apart force is always still within the desired range.

On the other hand, too low a spring-rate would mean that the operator had to deflect the arms through an inordinately long distance in order to achieve the desired clamp force. A spring rate of 400–700 Newtons per cm of deflection of the arms (i.e per cm of separation of the tappets) has been found to give a good balance between, on the one hand, the accommodation of the large tolerance band, and on the other hand, the need to move the arms apart only a modest distance.

It should be noted that the desired force for holding the rubber strips to the rail, i.e the 2–3 kN, applies even when the strips are done to different designs. For example, some strips have a wide profile and need the spring-clips to have a large straddle-distance or span; whereas other strips, which have to accommodate different types of track clips for example, can be quite narrow. In these cases, the designer would provide that the beam portion of the spring-clip would be long or short, as required.

It should be noted that the spring-rate of the spring-clip is proportional to the span of the spring-clip. Whatever the particular length of beam, as dictated by the span required to straddle the strips, the designer should arrange for the spring-clip to have a rate of 400–700 N per cm at the tappets. If the span of the beam has to be long, the designer should specify a somewhat larger diameter for the bar from which the spring-clip is made, in order to achieve a spring-rate in the 400–700 N per cm range, at the tappets. (In other words, the designer should have it in mind that he is designing a spring-clip, as distinct from a rigid screw-cramp.)

It should also be noted that there can be quite large variations in the slack take-up distance that the spring-clip must accommodate. The worker might have to turn the screw through a distance of say 5 cm on spring-clip A before the tappet has bottomed onto the groove, whereas the slack take-up at spring-clip B might be only 3 cm. Again, the designer does not wish to leave it to the installation worker to determine the point at which the slack is fully taken up, and further turning of the screw will now lead to bending the arms of the spring-clip apart. The designer provides simply that the worker turns the screw until the screw can turn no further. But the total distance turned by the screw aggregates the slack take-up distance and the bend-the-arms distance. If the slack take-up distance at spring-clip A happens to be smaller than the slack take-up distance at spring-clip B, the arms of spring-clip A will be bent apart further than the arms of spring-clip B, when the screws of both spring-clips are bottomed out. It is recognized that the spring-rates and other characteristics as described herein allow the designer to accommodate such variations.

In FIG. 6, maximum separation of the tappets, with the screw fully back to the right, is 29 cm. When the screw is fully forwards, until it bottoms, and the strips can be compressed no further, the separation of the tappets is 22 cm. Although the rubber strips are compressed by the action of the spring-clip, in fact the rubber is much less compressible than the arms of the spring-clip. In FIG. 6, the bar is a nominal (slightly flattened, as mentioned). The screw-thread is a nominal 13 mm.

Figure 7:
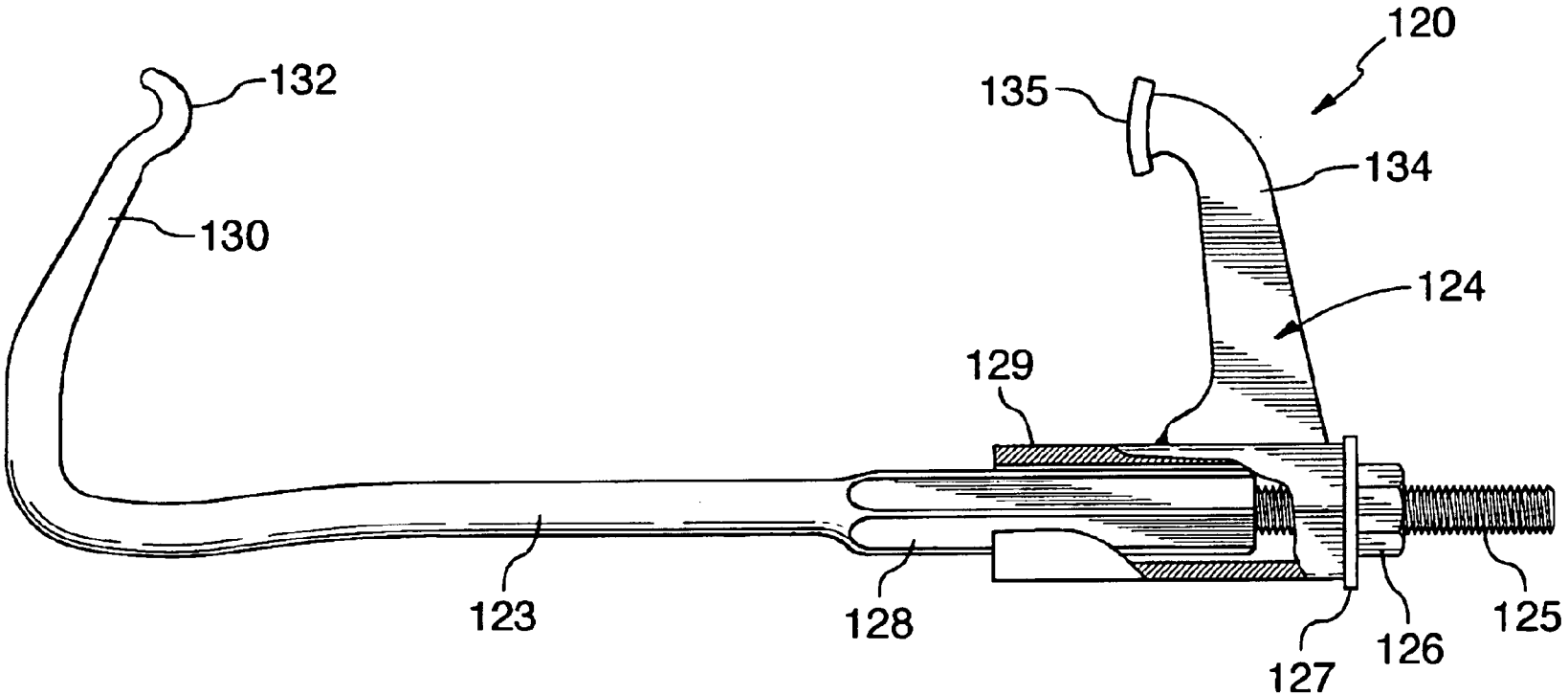
FIG. 7 is an elevation, similar to that of FIG. 6, of another form of spring-clip.
Figure 9:
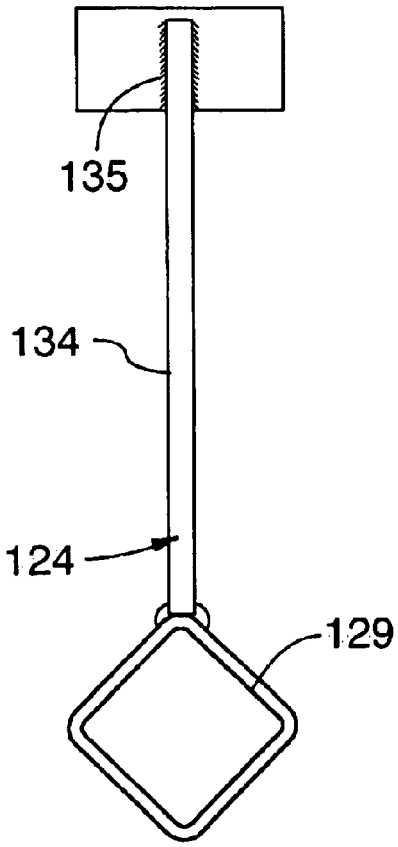
FIG. 9 is an end view of the right end of the spring-clip of FIG. 7.
Figure 8:
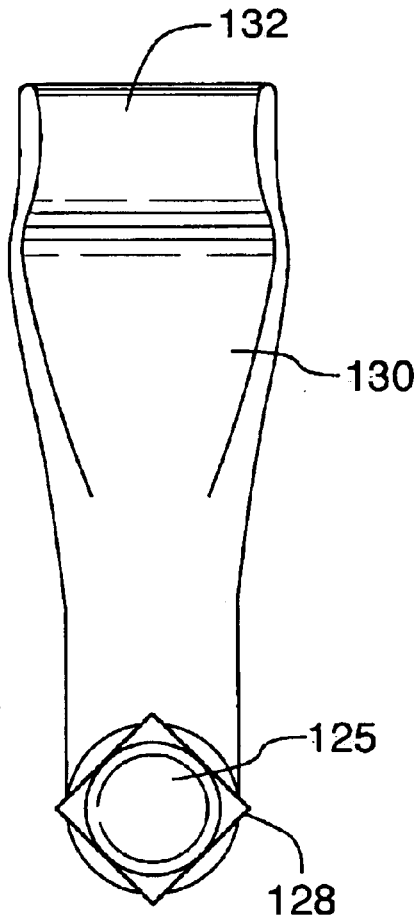
FIG. 8 is an end view of the left end of the spring-clip of FIG. 7.

FIGS. 7,8,9 show an alternative form the spring-clip may take. The spring-clip 120 comprises a bar 123, and a slider 124. The bar 123 is screw-threaded at 125, to which is threaded a nut 126 and a washer 127.

The bar 123 is formed (e.g. squeezed in a press) into a square-form 128. The slider 124 includes a length 129 of square tubing, which is a sliding fit over the square-form 128, whereby the slider 124 can slide axially along the bar 123, but cannot rotate relative to the bar.

The left end of the bar 123 is bent around, and pressed into a hook-form 130. The hook terminates in a left tappet 132.

The slider 124 also includes an arm 134, on which is carried a right tappet 135. The arm 134 is welded to the square tubing 129. The distance D between the tappets 132, 135 can be adjusted by sliding the slider 124 along the bar 123. The slider can be locked in place, on the bar 123, by means of the nut 126.

The spring-clip 120 is somewhat elastic, i.e not rigid, whereby the distance D between the tappets increases as force is applied tending to drive the tappets apart. The spring-clip is elastic enough that the tappets 132,135 can move apart a substantial distance, by deflection of the bar 123, the hook-form 130, the arm 134, and the other components of the spring-clip, when such a force appears between the tappets.

It can be important that there be resilience in the structure by means of which the rubber strips are held against the sides of the rail. One reason is that, as asphalt is being poured around the strips and the spring-clips, there can be some tendency for the strips and clips to be knocked accidentally, and to become dislodged. The resilience means that some substantial clamping force remains, even if the clips or strips should be knocked and dislodged. If there were no resilience, knocking the clips might cause them to loosen. The clips and strips should not be allowed to become loose, because that might allow a gap to open between the strips and the sides of the rail. Again, the clips should not be allowed to work loose later, during the service life of the crossing, as trains pass over the crossing, noting that the passage of trains can cause the rails to undergo considerable up/down movement, relative to the asphalt of the road. By clamping the strips to the rails with a large degree of resilience, even gross distortions and deflections of the road/rail interface do not cause the strips to separate clear from the rails.

The interface strips running alongside the rail are made of rubber. However, the rubber strips, though deflectable, usually cannot be regarded as being resiliently deflectable, in a substantive sense. That is to say: if the rubber is compressed, the rubber will deflect, but the rubber will not spring back (or will not fully spring back) later, if released. It is the metal spring-clip that supplies the elastic resilience, rather than the rubber. However, in some cases, the rubber strip can be resilient (i.e springy) enough, in itself, to be useful in reducing the chance of the rubber ever becoming loose with respect to the rail. In that case, where the rubber is resilient, the spring-clip can be more rigid. Both the clip and the rubber strips are resilient, the contributions of the two making up the necessary whole.

Since the rubber used for forming the strips is generally of a high hysteresis, and displays low elasticity, when deflected, it is preferred to provide the required resilience in the spring-clip, rather than in the rubber. Preferably, the spring-rate of the clip should be greater than the spring-rate of the assembled interface strips. Or at least, if less, it should not be much less. Even when the designer requires a clip that is more rigid, preferably the clip should still be elastic enough for the tappets to be forcefully spaced 2 or 3 cm apart, without the clip yielding, i.e without taking a permanent set.

The designer might provide that, during assembly of the spring-clip to the rail, the nut and washer can be removed, and the slider 124 also removed, in order to facilitate the operation of manoeuvring the bar under the rail. However, some designers prefer that the spring-clip not be dismantled for assembly purposes, as, if dismantling takes place, a clumsy operator might drop/lose the nut and washer.

Where the nut 126, washer 127, and arm 124, are removed for initial placement of the bar 123 under the rail, of course the length of the bar may be shorter. Where the designer prefers that the spring-clip be assembled into place under the rail, as a unitary whole structure, now the designer must ensure the un-dismantled spring-clip can be opened widely enough to permit the tappets to be manoeuvred around the rail, and around the rubber strips lying along the sides of the rail, with the nut 126 still present on the threaded portion 125. The threaded portion should be long enough to accommodate an opening of 32 cm, between the tappets, if the clip is to be assembled whole.

The spring-clips serve basically two purposes. One is to hold the left and right strips in place against the sides of the rail, and to hold the strips tightly and securely against the rail while the asphalt (or other road material) is being poured and filled, and then rolled and packed. The designer must see to it that the clips do not tend to become dislodged during this procedure. It is important that the clips can be easily done up to the correct tightness and resilience, and it is important that an inspector can easily see they have been done correctly, before the asphalt is applied, since after that it is very difficult to detect, and to correct, any faults. The second purpose of the clips is to keep the strips held tightly against the sides of the rail, even though the rails may move considerably, relative to the road material, as trains pass over the crossing. Once the strips have been allowed to work loose, the problem rapidly deteriorates, as grit and other debris starts to accumulate in the now-opened gap between the rail and the strip.

When carrying out repair work at crossings, while freedom from the need for special tools is important, it is hardly disadvantageous if conventional everyday tools are required for installing the clips. Thus, a powered nut-runner may be used to run up the nuts of all the clips, preferably all to the same torque. No great skill is needed by the operator to do this—which may be contrasted with the previous practice of holding interface strips in place by driving spikes into the ties, and bending the heads of the spikes over.

Figure 3:
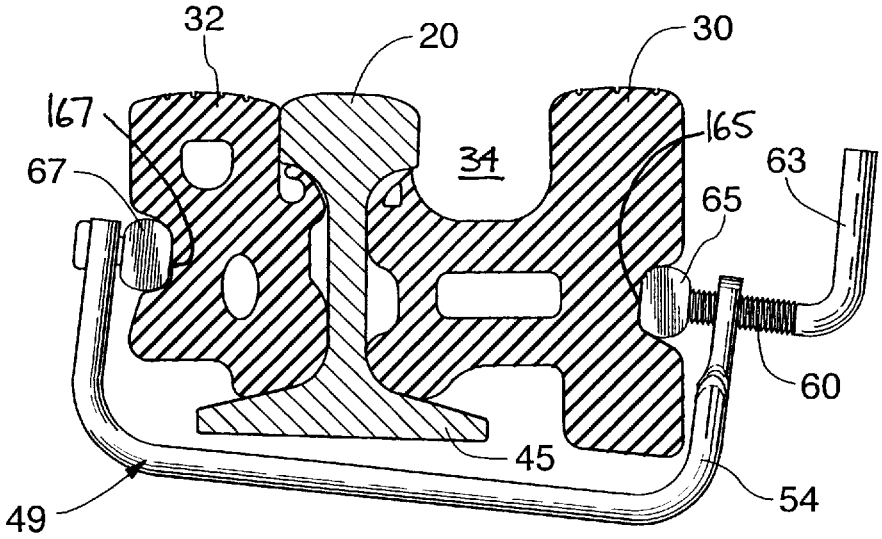
FIG. 3 is a view of the spring-clip of FIG. 1.

Once the spring-clip has been assembled into place around the rubber interface strips, the operator places the left tappet in its groove in the left strip, and winds the adjuster until the right tappet seats in its groove in the right strip. Attention is directed to FIG. 3, which shows the spring-clip 49 in an un-deflected, or no-load, condition. The operator has adjusted the screw mechanism such that the tappets 65, 67 are just touching the respective grooves 165, 167 in the sides of the profiles of the rubber interface strips 30, 32. This is the slack-take-up position. If the screw-thread is now operated further, in the direction to tighten the tappets together, the strips will be compressed, and the spring-clip will bend and deflect in the manner illustrated in FIG. 4.

It will be noted, in FIG. 3, that the groove 167 in the field-side strip 32 is higher than the groove 165 in the gauge-side strip 30. The height of the groove 165 in the gauge-side is dictated by the presence of the wheel-flange recess 34 in the gauge-side profile. The two rubber profiles are compressed along the line joining the two tappets, and it is desirable that that line should define an axis of symmetry, at least approximately, as far as the compression-supporting capability of the gauge-side rubber profile is concerned. Thus, on the gauge-side, the compression-supporting rubber should be more or less evenly disposed, about the line of action of the compressive force, i.e about the line joining the tappets. If the profile were not symmetrical, above and below that line, the profile might tend to tilt, or to be distorted unevenly, when squeezed against the rail. Thus, the groove 165 has to be low, so that the profile can be subjected to symmetrically distributed stresses, when loaded.

In fact, the gauge-side groove 165 is below the middle of the web of the rail. But the line of compression of the rubber (i.e the line joining the tappets) preferably should pass more or less through the middle of the web of the rail. The profile of the gauge-side strip is quite different from the profile of the field-side strip, but both profiles have the rubber material relieved towards the centre of the web. That is to say, both rubber profiles touch the respective sides of the web only at the top and bottom of the web; or rather, each rubber profile is shaped to tuck into the crook between the web and the head of the rail, and into the crook between the web and the base flange of the rail, and not to touch the web in the middle. This manner of interaction is preferable to having the rubber touch the web in the middle, because it results in the strip being located very securely, vertically, relative to the rail. The force derived from the spring-clip is horizontal, but both strips are so shaped as to utilise that horizontal force in such manner as to ensure that the strip is held with stability, and very securely, vertically, relative to the rail.

In fact, the line between the tappets is not quite horizontal, as shown in FIG. 3, but is inclined a few degrees from the horizontal. But the angle of inclination is small enough that, from the standpoint of the directionality of the applied force, it is as if the force were applied horizontally, i.e the angle is small enough that any vertical component of the force applied to the strips can be ignored. However, the line joining the tappets is inclined enough that the line of action of the force holding the strips to the sides of the rail passes roughly through the middle of the web of the rail. Thus, the inclined line means that both profiles are loaded in an even, and therefore stable, manner, against their respective sides of the rail, despite the presence of the wheel-flange recess 34 in the gauge-side profile.

Because the groove on the field-side strip is higher than the groove on the gauge-side strip, it is better for the spring-clip to be assembled with the adjusting and fastening mechanism on the gauge-side, so that the mechanism resides down low, where it will be buried deeply in the asphalt.

What is claimed is:

1. Apparatus for securing left and right interface strips to the sides of a rail at a road-rail crossing, in combination with the strips and the rail, wherein:

the strips lie fitted to the rail, and have respective outer side-surfaces, which face away from the rail;

the apparatus includes a spring-clip, which is made of metal;

the spring-clip is of a U-configuration, having a central beam and having left and right arms;

the central beam of the spring-clip lies underneath the rail and the strips, and the arms lie outside the outer side-surfaces of the strips, left and right tappets on the arms being in contact with corresponding tappet-receiving points on the outer side-surfaces of the strips;

the apparatus is so structured that a distance D, as measured between the left and right tappets, is adjustable, and can be adjusted from a distance D1 to a distance D2, the distances D1 and D2 being measured when the spring-clip is in an unstressed condition;

the distance D1 is the distance apart of the tappets when the tappets are just touching the tappet-receiving points;

the apparatus includes an adjustable lock, which is operable to lock the tappets the distance D2 apart;

the springiness arid resilience of the arms and the beam of the spring-clip are such that the tappets can be forcefully deflected apart, whereupon the distance between the tappets is increased by a deflection-distance DDef;

the deflection-distance DDef is small enough that the spring-clip does not take a permanent set;

the deflection-distance DDef is at least six centimeters;

D2 is smaller than D1 by at least DDef;

the spring-clip lies assembled around the strips, in such condition that the tappets lie locked the distance D2 apart, and the tappets lie forcefully deflected the distance DDef apart, and lie pressed against the tappet-receiving points of the strips.

2. Apparatus for securing left and right interlace strips to the sides of a rail at a road-rail crossing, in combination with the strips and the rail, wherein:

one of the strips lies on the field-side of the rail, and the other on the gauge-side;

the gauge-side strip includes a recess for accommodating the wheel-flanges of trains passing over the crossing;

the strips lie fitted to the rail, and have respective left and right outer side-surfaces, which face away from the rail;

the apparatus includes a spring-clip, which is made of metal;

the spring-clip is of a U-configuration, having a central beam and having left and right arms;

the central beam of the spring-clip lies underneath the rail and the strips, and the arms lie outside the outer side-surfaces of the strips;

the left and right arms carry respective left and right tappets;

the side-surfaces of the strips are formed with respective left and right tappet-grooves, running lengthwise, along the strips, in their respective side-surfaces, and the tappets lie engaged in the tappet-grooves;

the apparatus is so structured that a distance D, as measured between the left and right tappets, is adjustable, and can be adjusted from a distance D1 to a distance D2, the distances D1 and D2 being measured when the spring-clip is in an unstressed condition;

the distance D1 is the distance apart of the tappets when the tappets are in a slack-take-up position, in which the tappets lie just seated into the respective tappet-grooves in the strips;

the apparatus includes an adjustable lock, which is operable to lock the tappets the distance D2 apart;

the distance D2 is smaller than the distance D1;

the springiness and resilience of the arms and the beam of the spring-clip are such that the tappets can be forcefully deflected apart, whereupon the distance between the tappets is increased by a deflection-distance DDef, which is small enough that the spring-clip does not take a permanent set;

the deflection-distance DDef is of a substantial magnitude;

D2 is smaller than D1 by at least DDef;

the apparatus includes many spring-clips having the characteristics listed above, arranged between the railway cross-ties;

the many spring-clips lie with their left and right tappets locked the distance D2 apart, and forcefully deflected the distance DDef apart.

3. Apparatus of claim 2, wherein the deflection-distance DDef, through which the tappets can be forcefully deflected apart, is large enough that the spring-clip can be characterised as being a springy and resilient structure.

4. Apparatus of claim 2, wherein the spring-clip is so structured that the distance DDef that the tappets can be forced apart without taking a permanent set, is at least two centimeters.

5. Apparatus of claim 2, wherein the tappet-grooves are deep enough that the spring-clip is supported by the engagement of the tappets in the tappet-grooves, without any other support, and is held supported thereby when the adjustable lock is operated, thereby bending the arms apart and applying a heavy force clamping the two strips to the sides of the rail.

6. Apparatus of claim 2, wherein:

the distance D, being the distance apart of the tappets, is measured along a tappet-line, being a straight line joining the tappets, and joining the tappet-grooves;

the cross-sectional profile of the rail includes wide upper and lower elements, joined by a narrow vertical web;

the tappet-line passes through a point of the web midway between the upper and lower elements;

the tappet-line lies inclined slightly, relative to horizontal;

the inclination of the tappet-line is such that the tappet-line is lower at the gauge-side of the rail.

7. Procedure of claim 2, wherein the adjustable lock is a structure lying mainly to one side of the rail, and the adjustable lock lies on the gauge-side.

8. Apparatus of claim 2, wherein the slack-take-up distance D1 is about twenty-one centimeters.

9. Apparatus of claim 2, wherein the many spring-clips lie buried in the material of the roadway.

10. Apparatus of claim 2, wherein:

the strips are of an elastomeric material, which is capable of undergoing compressive deflection when force is applied between the tappets;

the magnitude of the compressive deflection of the elastomeric strips, for a given magnitude of the force applied between the tappets, is substantially smaller than the magnitude of the distance DDef through which the spring-clip is deflected by same force.

11. Apparatus of claim 2, wherein, in respect of one of the clips:

the right arm is structurally separate from the beam, and is mounted on the beam for sliding therealong;

the adjustable lock comprises a screw-thread connection between the beam and the right arm, whereby the right arm can be locked at a position of adjustment, along the beam.

12. Apparatus of claim 11, wherein the left arm and the beam are structurally integrated in and as one piece of metal.

13. Apparatus of claim 11, wherein the beam is long enough that the right arm can be withdrawn to the right, along the beam, far enough that the tappets can be fitted over the strips, and into the tappet-grooves, while the right arm still remains on the beam, with the screw thread connection intact.

14. Apparatus of claim 11, wherein the right arm and the beam include a non-round engagement therebetween, whereby the right arm is prevented from rotating around the beam.

15. Apparatus for securing left and right interface strips to the sides of a rail at a road-rail crossing, in combination with the strips and the rail, wherein:

one of the strips lies on the field-side of the rail, and the other on the gauge-side;

the gauge-side strip includes a recess for accommodating the wheel-flanges of trains passing over the crossing;

the strips lie fitted to the rail, and have respective left and right outer side-surfaces, which face away from the rail;

the apparatus includes a clip, which is made of metal;

the clip is of a U-configuration, having a central beam and having left and right arms;

the central beam of the clip lies underneath the rail and the strips, and the arms lie outside the outer side-surfaces of the strips;

the left and right arms carry respective left and right tappets;

the outer side-surfaces of the strips are formed with respective left and right tappet-grooves, running lengthwise, along the strips, in their respective side-surfaces, and the tappets lie engaged in the tappet-grooves;

the apparatus is so structured that a distance D, as measured between the left and right tappets, is adjustable, and can be adjusted from a distance D1 to a distance D2, the distances D1 and D2 being measured when the clip is in an unstressed condition;

the distance D1 is the distance apart of the tappets when the tappets are in a stack-take-up position, in which the tappets lie just seated in the respective tappet-grooves in the strips;

the apparatus includes an adjustable lock, which is operable to lock the tappets the distance D2 apart;

the distance D2 is smaller than the distance D1;

the strips are made of an elastomeric material, which is capable of undergoing compressive deflection, when force is applied between the tappets;

the springiness and resilience of the arms and the beam of the clip, together with the springiness and resilience of the elastomeric strips, are such that the tappets can be forcefully deflected apart, and the strips can be forcefully compressed, whereupon the distance between the tappets is reduced by a deflection-distance DDef, which is small enough that neither the arms and beam of the spring-clip nor the elastomeric strips take a permanent set;

D2 is smaller than D1 by at least DDef;

the apparatus includes many clips having the characteristics listed above, arranged between the railway cross-ties;

the many clips lie with their left and right tappets locked the distance D2 apart, and forcefully deflected the distance DDef apart.

* * * * *